United States Patent [19]

Gergoe

[11] Patent Number: 4,796,929

[45] Date of Patent: Jan. 10, 1989

[54] CLOSURE LATCH CONTROL MECHANISM

[75] Inventor: Bela Gergoe, Birmingham, Mich.

[73] Assignee: General Motors Corporation, Detroit, Mich.

[21] Appl. No.: 92,102

[22] Filed: Sep. 2, 1987

[51] Int. Cl.[4] ..... E05C 3/26

[52] U.S. Cl. ..... 292/28; 292/336.3

[58] Field of Search ..... 70/256; 292/28, 216, 292/280, 50, 26, 36, DIG. 14, DIG. 25

[56] References Cited

U.S. PATENT DOCUMENTS 2,924,473 2/1960 Krause ..... 292/DIG. 14 X 3,309,127 3/1967 Pickles ..... 292/216

3,400,962 9/1968 Martens ..... 292/216

3,601,434 8/1971 Fargo ..... 292/DIG. 14 X

*Primary Examiner*—Richard E. Moore

*Attorney, Agent, or Firm*—Herbert Furman

[57] ABSTRACT

A closure latch control mechanism includes separately operable levers connected to inside and outside operating handles and to a coupling member for relatively shifting cable and sheath members connected to a cable operated closure latch. A locking lever controls the position of the coupling member to couple and uncouple this member and the cable and sheath members.

1 Claim, 1 Drawing Sheet

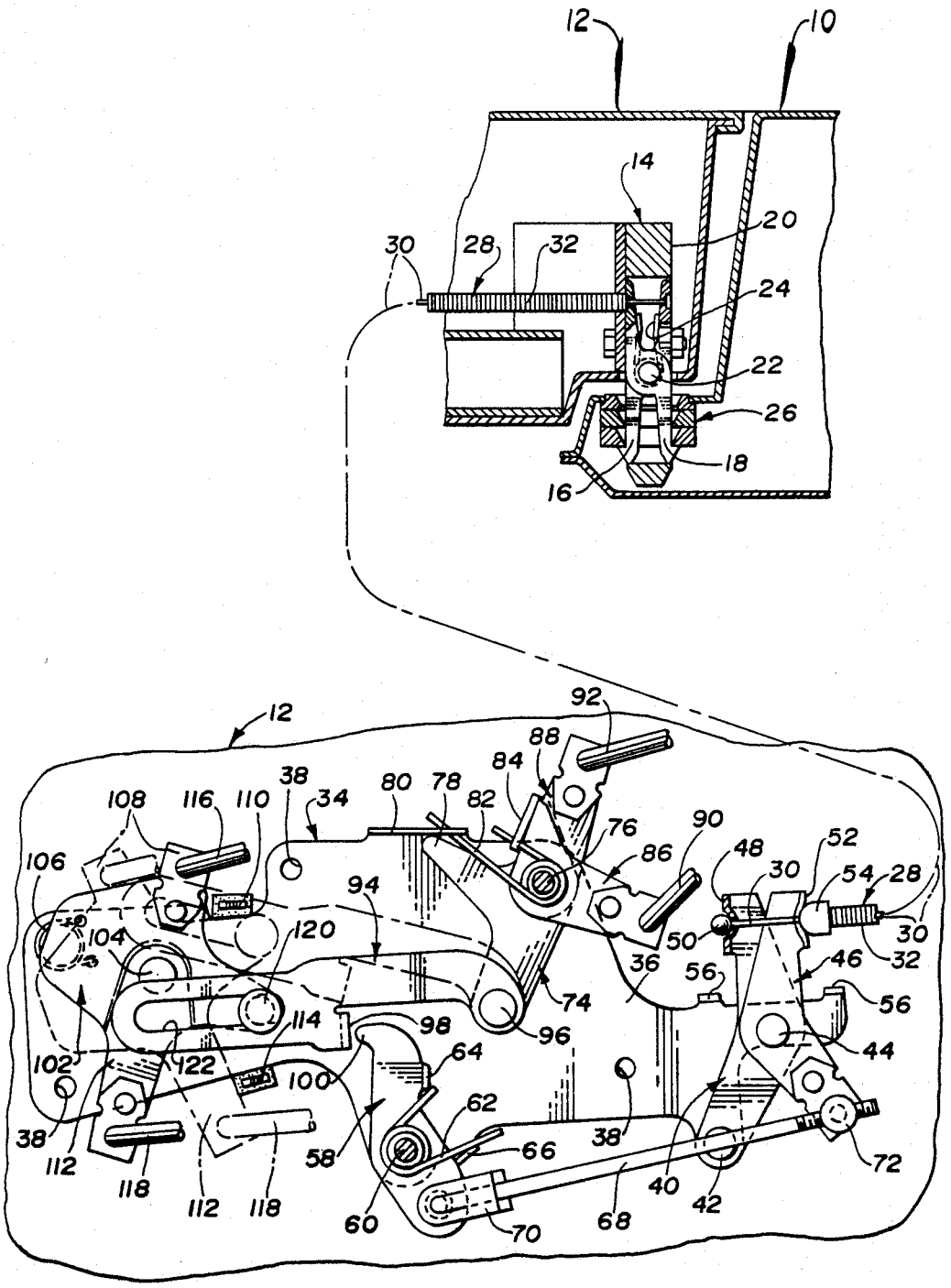
12
10
14
20
30
28
32
24
22
26
18
16
12
92
88
84
38
80
78
82
34
108
116
110
76
90
86
48
52
30
54
28
106
94
104
120
50
30
32
36
56
46
74
56
114
98
96
44
102
122
100
64
62
38
112
118
58
66
38
72
112
118
40
42
60
70
68

CLOSURE LATCH CONTROL MECHANISM

This invention relates generally to closure latch control mechanisms and more particularly to a control mechanism for operating cable operated vehicle closure latches.

Certain types of vehicle closure latches are operated through the use of cable mechanisms including a cable member and a sheath member which move relative to each other in order to operate the closure latch. Application Ser. No. 087,043 Baynes, Closure Latch, filed Aug. 19, 1987, is an example of a closure latch of this type. Generally, the closure latch includes a pair of latch bolt members which are pivoted to each other in scissors fashion for movement inwardly and outwardly of a housing between unlatched and latched positions. The latch bolt members are normally biased outwardly of the housing to latched position by spring means and are moved inwardly of the housing to an unlatched position through the relative movement of a cable member connected to one latch bolt member and a sheath member connected to the other latch bolt member.

The control mechanism of this invention can be mounted anywhere within the vehicle door and provides for a control of the relative movement of the cable member and sheath member in order to connect the operating handles and locking mechanisms of the door with the closure latch so as to perform various selected latch functions.

The primary feature of this invention is that it provides a closure latch control mechanism for connecting the operating members and locking mechanisms of a vehicle closure with a cable operated closure latch in order to perform various selected latch functions.

This and other features will be readily apparent from the following specification and drawing wherein The FIGURE of the drawing shows a control mechanism according to this invention for operating a cable operated vehicle closure latch.

Referring now to the drawing, the portion of the FIGURE in the upper righthand corner is the same as FIG. 1 of application Ser. No. 087,043 Baynes, Closure Latch, filed Aug. 19, 1987, and assigned to the assignee of this invention. Generally this portion of the FIGURE shows a vehicle 10 having a front door 12 which is conventionally hinged at its forward edge to the vehicle 10 for movement between a closed position as shown, and an open position, not shown. The door 12 is held in closed position by a closure latch designated generally 14 which includes a pair of latch bolt members 16 and 18 which are pivoted to each other and to a housing 20 by a pivot 22. Housing 20 is mounted on door 12 adjacent the rearward edge thereof. A coil torsion spring 24 surrounds the pivot 22 and biases the latch bolt members 16 and 18 oppositely of each other and outwardly of housing 20 to their latched position as shown wherein the hook shaped free ends of the latch bolt members engage a striker assembly 26 mounted on the vehicle 10. In order to release the door 12 for movement to open position, the latch bolt members 16 and 18 must be moved inwardly of housing 20 to unlatched position to release their hook shaped free ends from the striker assembly 26. This is accomplished by a cable mechanism 28 which includes a cable member 30 having one end connected to the operated end of the latch bolt member 16 and a sheath member 32 having one end 32 connected to the operated end of the latch bolt member 18. Relative movement of the sheath member and the cable member moves the operated ends of the latch bolt members toward each other to move their hook shaped free ends within housing 20 and out of engagement with the striker assembly 26 to permit door 12 to be opened. The foregoing is a brief description of this closure latch and reference made be had to the aforenoted application for further specific details.

In order to connect the cable member 30 and sheath member 32 to the operating handles and locking mechanisms of door 12, a control mechanism 34 according to this invention is provided. As will be apparent from a further description, the mechanism 34 provides an interconnection between the sheath and cable members 30 and 32 and the operating handles and locking mechanisms of door 12. The control mechanism 34 can be mounted in place within door 12 where there is space and where it is possible to connect the control mechanism 34 to the operating handles and locking mechanisms. The mechanism 34 includes a support or plate 36 which is apertured at various places such as 38 for mounting to door 12. A first lever 40 is pivoted at 42 to plate 36 and pivoted at 44 to a second lever 46. The free end of the lever 40 includes a notched lateral tab 48 which anchors a ball 50 secured to the other end of the cable member 30 to thereby connect lever 40 and the latch bolt member 16. The lever 46 includes a slotted lateral tab 52 which receives the cable 30 therethrough and provides a seat for an abutment member 54 secured to the other end of sheath member 32 to thereby connect the lever 46 and the latch bolt member 18. Lateral tabs 56 on an edge of plate 36 act as limit stops for pivotal movement of lever 40 relative to pivot 42.

An intermediate lever 58 is pivoted at 60 to the plate 36. A coil torsion spring 62 surrounds the pivot 60. One leg of the spring 62 engages a lateral tab 64 of lever 58 and the other leg of the spring engages a lateral tab 66 of plate 36 to bias lever 58 counterclockwise about pivot 60 and into engagement with tab 66. A rod 68 has one end secured to the lever 58 by a conventional clip 70 and the other end adjustably pivoted at 72 to the lever 46. Rotational movement of the lever 58 clockwise about the pivot 60 shifts the rod 68 to the left and rotates lever 46 clockwise about pivot 44 to move sheath 32 to the right. This moves the operated ends of the latch bolt members 16 and 18 toward each other to move the hook shaped free ends thereof inwardly of housing 20 and release door 12 of movement to open position.

A lever 74 is pivoted at 76 to the plate 36 and has one leg 78 thereof engaging a lateral tab 80 of the plate under the bias of a coil torsion spring 82 engaged between a notch of tab 80 and a notch of tab 84 of lever 74. A first operating lever 86 and a second operating lever 88 are coaxially pivoted with the lever 74 on pivot 76. Tab 84 provides a limit stop limiting counterclockwise movement of levers 86 and 88 by engagement with a foot of the former and a side edge of the latter.

A rod 90 pivotally connects the lever 86 to the outside operating handle of door 12, not shown, and a rod 92 pivotally connects the lever 88 to the inside operating handle of door 12, also not shown. Both handles are conventional.

A coupling member 94 has one end thereof pivoted at 96 to the lever 74. The lever 94 includes an intermediate lateral tab 98 which, when the lever 94 is in its coupled position as shown, lies in the path of an abutment 100 of lever 58. Upon operation of either the inside or the outside handle to rotate lever 88 or lever 86 counterclockwise, the lever 74 will be rotated in the same direction against the bias of spring 82 to shift the coupling member 94 to the right and in turn rotate lever 58 clockwise by the engagement of tab 98 with abutment 100. This will move the latch bolt members 16 and 18 to unlatched position as previously described.

The coupling member 94 is movable between its coupled position shown in full lines and an uncoupled position shown in dash lines by a locking means which will now be described. A locking lever 102 is pivoted at 104 to the plate 36 and is selectively and alternately biased to its unlocked full line position and its locked dash line position by an overcenter type coil torsion spring 106 hooked between the plate 36 and the lever 102. The engagement of an arm 108 of the lever 102 with a rubber bumper covered tab 110 of plate 36 locates the locking lever 102 in its unlocked position. The engagement of an arm 112 of the lever 102 with a rubber bumper covered tab 114 of plate 36 locates the locking lever in its locked position. A rod 116 pivotally connects the arm 108 with the garnish button or inside locking mechanism of door 12, and a rod 118 connects the arm 112 of lever 102 with the outside locking mechanism or key cylinder assembly. Operation of either the inside or outside locking mechanism moves the locking lever 102 between its locked and unlocked positions.

The locking lever 102 mounts a headed stud 120 which is received within slot 122 of the coupling member 94. When the locking lever 102 is in unlocked position, it locates the coupling member in coupled position as shown in full lines. When the locking lever is in locked position it rotates the coupling member 94 clockwise about pivot 96 to its dash line uncoupled position to move tab 98 out of the path of abutment 100 so that operation of either the inside or the outside handle to rotate lever 74 will cause the coupling member to bypass abutment 100 so that the latch bolt members 16 and 18 remain in latched position.

Thus this invention provides a control mechanism for operating cable operated vehicle closure latches.

The embodiments of the invention in which an exclusive property or privilege is claimed are defined as follows:

1. In combination with a closure latch including latch means movable between latched and unlatched positions by the relative movement of a cable member and a sheath member housing the cable member, a control mechanism for moving the cable and sheath relative to each other comprising, in combination, a support, a first lever pivoted to the support, a second lever pivoted to the first lever, means connecting the first lever to the sheath member, means connecting the second lever to the cable member, an intermediate lever pivoted to the support and operatively connected to the second lever for pivoting the second lever relative to the first lever to move the cable member relative to the sheath member and move the latch means to unlatched position, latch operating means operatively connected to independently actuatable inside and outside closure latch operators, a coupling member operatively connected to the latch operating means for movement upon operation of either the inside or the outside closure latch operator, the coupling member including means cooperatively engageable with the intermediate lever for pivoting the intermediate lever upon movement of the coupling member, and locking means operatively connected to the coupling member for moving the coupling member between a coupled position and a bypass position with respect to the intermediate lever, the coupling member engageable means bypassing the intermediate lever when the coupling member is in bypass position to uncouple the inside and outside operators from the intermediate lever and block movement of the latch means to unlatched position.

* * * * *